US010894699B2

(12) United States Patent
Schroeder et al.

(10) Patent No.: US 10,894,699 B2
(45) Date of Patent: Jan. 19, 2021

(54) LIGHTWEIGHT CRANE

(71) Applicants: Matthew Wendell Schroeder, Ventura, IA (US); Cory John Burrs, Corwith, IA (US); Jeramy Richard Voortmann, Clear Lake, IA (US)

(72) Inventors: Matthew Wendell Schroeder, Ventura, IA (US); Cory John Burrs, Corwith, IA (US); Jeramy Richard Voortmann, Clear Lake, IA (US)

(73) Assignee: STELLAR INDUSTRIES, INC., Garner, IA (US)

( * ) Notice: Subject to any disclaimer, the term of this patent is extended or adjusted under 35 U.S.C. 154(b) by 3 days.

(21) Appl. No.: 16/117,247

(22) Filed: Aug. 30, 2018

(65) Prior Publication Data

US 2019/0062129 A1 Feb. 28, 2019

Related U.S. Application Data

(60) Provisional application No. 62/552,898, filed on Aug. 31, 2017.

(51) Int. Cl.
*B66C 23/70* (2006.01)
*B66C 23/00* (2006.01)

(52) U.S. Cl.
CPC ..... *B66C 23/701* (2013.01); *B66C 23/705* (2013.01); *B66C 23/707* (2013.01); *B66C 23/708* (2013.01); *B66C 23/54* (2013.01)

(58) Field of Classification Search
CPC ... B66C 23/701; B66C 23/702; B66C 23/703; B66C 23/705; B66C 23/706; B66C 23/707; B66C 23/708
See application file for complete search history.

(56) References Cited

U.S. PATENT DOCUMENTS 3,721,054 A * 3/1973 Homagold ..... B66C 23/701 52/115
3,795,321 A * 3/1974 Johnston ..... B66C 23/705 212/177
3,802,136 A * 4/1974 Eiler ..... B66C 23/705 52/115

(Continued)

FOREIGN PATENT DOCUMENTS

EP 1344741 A1 * 9/2003 ..... B66C 23/701

OTHER PUBLICATIONS

Machine Translation for EP 1,344,741 (Year: 2003).*

*Primary Examiner* — Michael R Mansen
*Assistant Examiner* — Juan J Campos, Jr.
(74) *Attorney, Agent, or Firm* — David M. Breiner; BrownWinick Law Firm

(57) ABSTRACT

Example embodiments relate to a lightweight crane. In one nonlimiting embodiment the crane is comprised of a telescoping boom having a first boom nested in a second boom which in turn is nested in a third boom. The first, second, and third booms may be made from aluminum to reduce the weight of the crane. The first boom may have a first open section and a second closed section wherein the open section is configured to accommodate a structural member to which an actuator is attached. The first and second booms have lower surfaces with inclined surfaces so that the first boom self-aligns with the second boom and the second boom self-aligns with the third boom.

16 Claims, 11 Drawing Sheets

(56) References Cited

U.S. PATENT DOCUMENTS

| | | | | | |
|---|---|---|---|---|---|
| 3,985,234 | A * | 10/1976 | Jouffray | B66C 23/707 | 212/350 |
| 4,257,201 | A * | 3/1981 | Landolt | B66C 23/707 | 212/230 |
| 4,396,126 | A * | 8/1983 | Moravec | B66C 23/706 | 212/230 |
| 4,459,786 | A * | 7/1984 | Pitman | B66C 23/701 | 212/348 |
| 5,884,791 | A * | 3/1999 | Vohdin | B66C 23/701 | 212/348 |
| 6,499,612 | B1 * | 12/2002 | Harrgington | B66C 23/701 | 212/270 |
| 6,516,962 | B1 * | 2/2003 | Irsch | B66C 23/701 | 212/347 |
| 2010/0252697 | A1 * | 10/2010 | Koenig | B66C 23/701 | 248/161 |

* cited by examiner

LIGHTWEIGHT CRANE

BACKGROUND

Field

Example embodiments relate to a lightweight crane.

Description of the Prior Art

Conventional cranes are designed to carry relatively heavy loads. As a consequence, conventional cranes are designed using steel due to steel's high strength and stiffness. Steel, however, is a relatively heavy metal adding significant weight to the crane. Other materials, for example, aluminum, while light in weight, have traditionally been ignored as a material suitable for crane designs due to its relatively low strength and high flexibility.

SUMMARY

Example embodiments relate to a lightweight crane. In one nonlimiting embodiment the crane is comprised of a telescoping boom having a first boom nested in a second boom which, in turn, is nested in a third boom. The first, second, and third booms may be made from aluminum to reduce the weight of the crane. The first boom may have a first section and a second section. The first section may be an open section and may be configured to accommodate a structural member to which an actuator may be attached. The second section may be a closed section configured to carry shear loads. The first and second booms may have inclined lower surfaces so that the first boom self-aligns with the second boom and the second boom self-aligns with the third boom.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
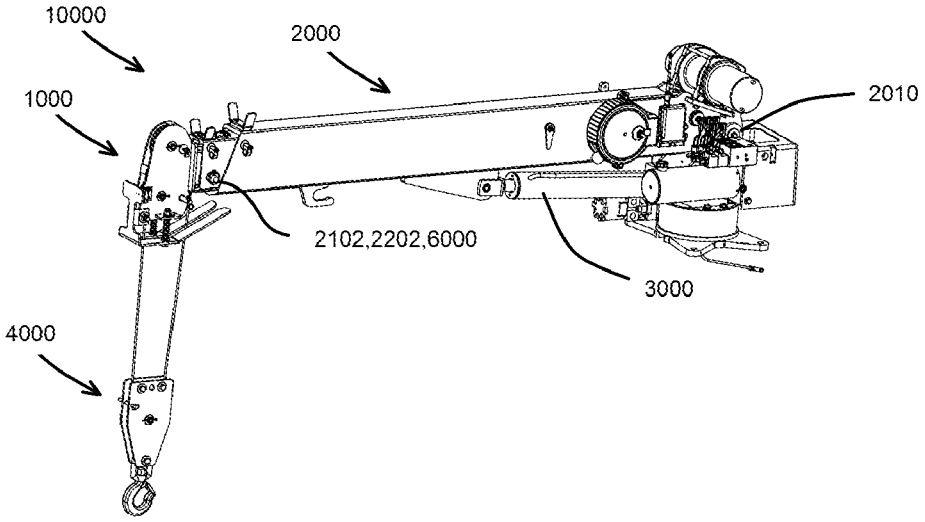
FIG. 1 is first perspective view of a crane in accordance with an example of the invention.

Example embodiments will now be described more fully with reference to the accompanying drawings, in which example embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on," "connected to," or "coupled to" another element or layer, it can be directly on, connected to, or coupled to the other element or layer or intervening elements or layers that may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another elements, component, region, layer, and/or section. Thus, a first element component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a light-weight crane.

Figure 2A:
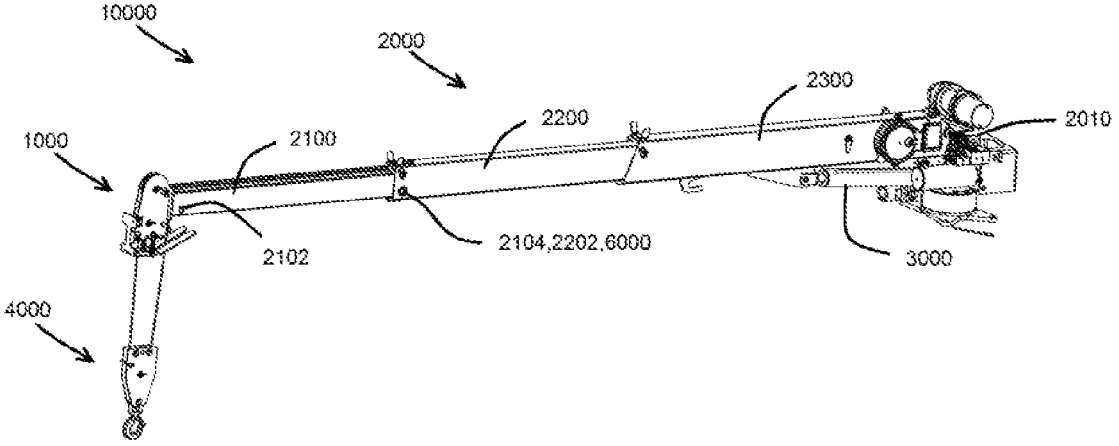
FIG. 2A is second perspective view of the crane in accordance with an example of the invention.
Figure 2B:
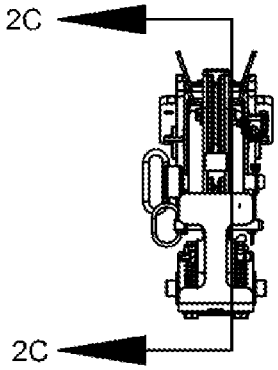
FIG. 2B is an end view of the crane in accordance with an example of the invention.
Figure 2C:
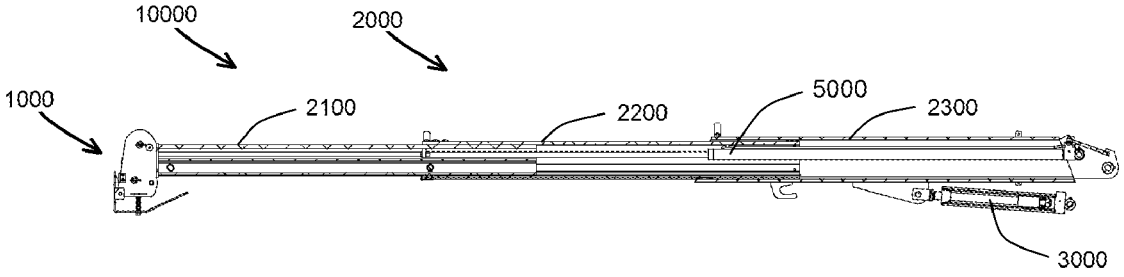
FIG. 2C is a section view of the crane in accordance with an example of the invention.

FIG. 1 is a view of a crane 10000 in accordance with an example of the invention. As shown in FIG. 1, the crane 10000 may be comprised of a horsehead assembly 1000 arranged at an end of a boom 2000. The boom 2000 may be pivotally connected at a first end 2010 to a base which may or may not be attached to a utility vehicle. A first actuator 3000, for example, a hydraulic cylinder, may be connected to the boom 2000 to pivot the boom 2000. Pivoting the boom 2000 may cause a pulley system 4000 at an end of the boom 2000 to move up and down. In example embodiments, the boom 2000 may be comprised of multiple telescoping members. For example, in the nonlimiting example of FIG. 1, the boom 2000 may include a first boom 2100, a second boom 2200, and a third boom 2300. FIG. 2A illustrates the crane 10000 of FIG. 1 having the boom 2000 extended and better showing the first boom 2100, the second boom 2200, and the third boom 2300. FIG. 2B is an end view of the crane 10000. FIG. 2C is a section view of the crane 10000 which shows a second actuator 5000 which may be used to extend the boom 2000.

Figure 3:
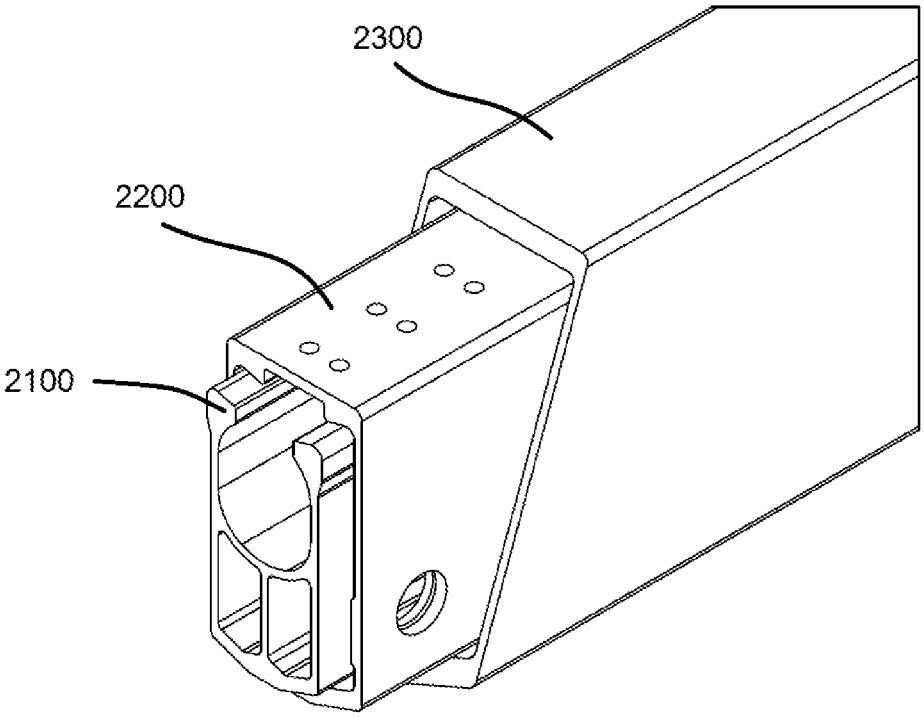
FIG. 3 is a partial perspective/section view of the crane in accordance with an example of the invention.

FIG. 3 is a partial perspective/section view of the boom 2000. As shown in FIG. 3, the first boom 2100 may nest inside the second boom 2200 which may, in turn, nest inside the third boom 2300. In example embodiments, the first boom 2100 may slide along the second boom 2200 and the second boom 2200 may slide along the third boom 2300. In this way, the boom 2000 may behave in a telescoping manner.

Figure 4A:
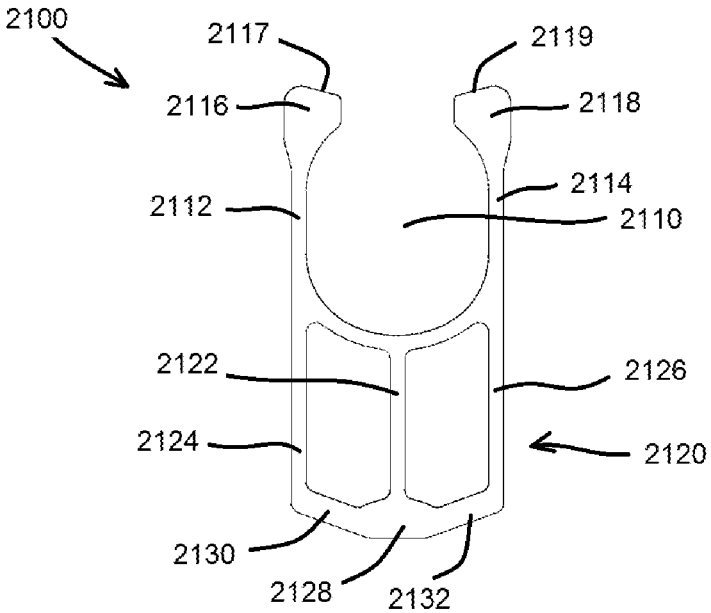
FIG. 4A is cross-section of a first boom in accordance with an example of the invention.
Figure 4B:
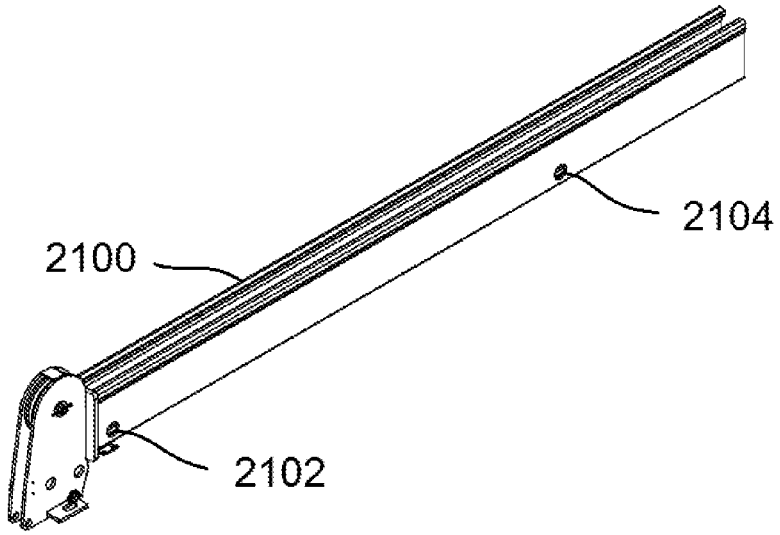
FIG. 4B is a perspective view of the first boom in accordance with an example of the invention.

FIG. 4A illustrates a cross-section of the first boom 2100. As shown in FIG. 4A, the first boom 2100 may include an open section 2110 and a closed section 2120. The open section 2110 may be formed by two side walls 2112 and 2114 having thickened ends 2116 and 2118. Top surfaces 2117 and 2119 of the thickened ends 2116 and 2118 may be sloped to interface with corresponding surfaces 2216 and 2218 of the second boom 2200. In example embodiments, the thickened ends 2116 and 2118 may be necessary to carry high bending loads as is traditionally associated with crane booms. The closed section 2120 may include a web 2122 and two side walls 2124 and 2126 which may carry shear loads to a bottom flange member 2128. The bottom flange member 2128 may have two sloped surfaces 2130 and 2132 which interface with corresponding surfaces 2242 and 2244 of the second boom 2200. FIG. 4B illustrates a perspective view of the first boom 2100 with a portion of the horsehead 1000 attached thereto.

Figure 5A:
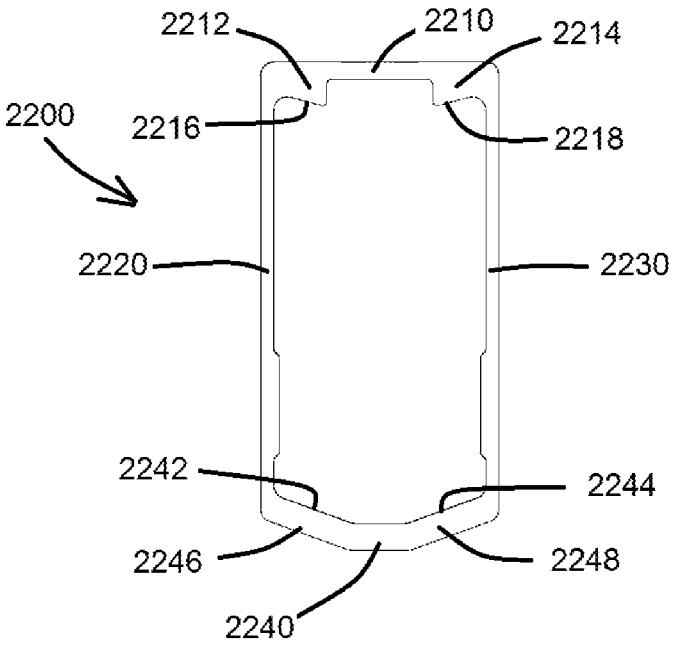
FIG. 5A is cross-section of a second boom in accordance with an example of the invention.
Figure 5B:
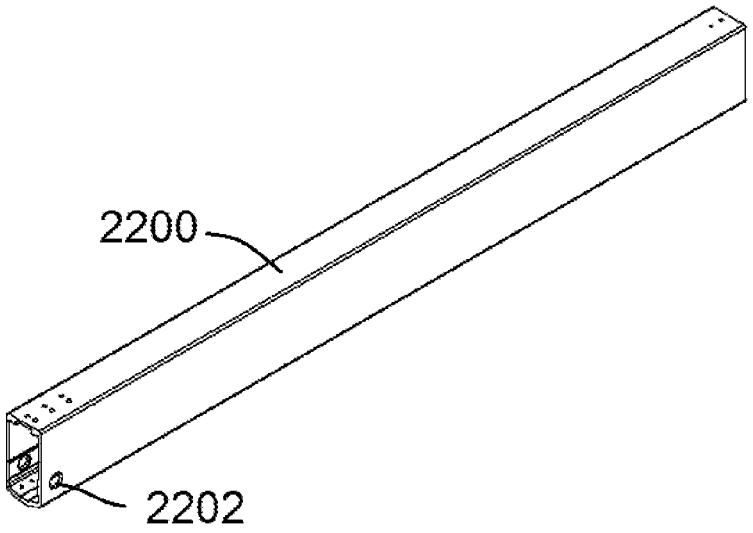
FIG. 5B is a perspective view of the second boom in accordance with an example of the invention.

FIG. 5A illustrates a cross-section of the second boom 2200. FIG. 5B is a perspective view of the second boom 2200. As shown in FIGS. 5A and 5B, the second boom 2200 resembles a tubular member having a top wall 2210, a pair of side walls 2220 and 2230, and a bottom wall 2240. The top wall 2210 may have thickened portions 2212 and 2214 having sloped surfaces 2216 and 2218 configured to interface with the sloped surfaces 2117 and 2119 of the first boom 2100. The interface of the sloped surfaces 2216 and 2117 and the sloped surfaces 2218 and 2119 limit deformation of the side walls 2112 and 2114 under a load. The bottom wall 2240 may also include a pair of interior sloped surfaces 2242 and 2244 which may interface with the sloped surfaces 2130 and 2132 of the first boom 2100. The interface of the sloped surfaces 2242 and 2244 with sloped surfaces 2130 and 2132 cause the first boom 2100 to align and center within the second boom 2200. In addition, this interface resists side-to-side motion of the first boom 2100 while it is in the second boom 2200 and the interface reduces stress concentration that would otherwise exist at ninety degree corners in a conventional flat bottom design.

Figure 6:
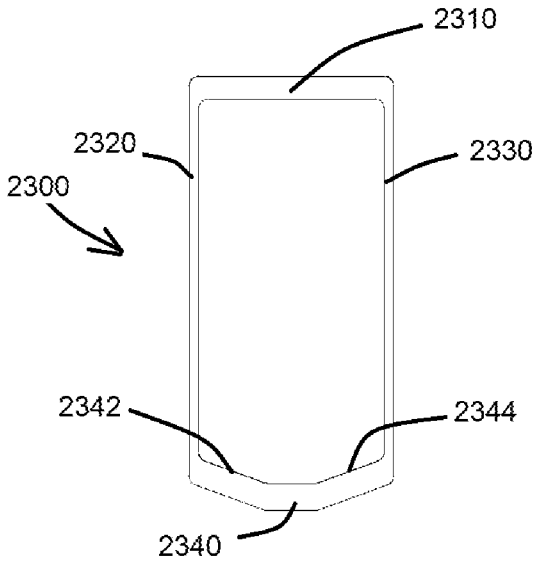
FIG. 6 is cross-section of a third boom in accordance with an example of the invention.

FIG. 6 illustrates a cross-section of the third boom 2300. As shown in FIG. 6, the third boom 2300 resembles a tubular member having a top wall 2310, a pair of side walls 2320 and 2330, and a bottom wall 2340. The bottom wall 2340 may include a pair of sloped surfaces 2342 and 2344 that interface with sloped surfaces 2246 and 2248 of the second boom 2200. The interface of the sloped surfaces 2342 and 2344 with the sloped surface 2246 and 2248 cause the second boom 2200 to align and center within the third boom 2300.

Figure 7:
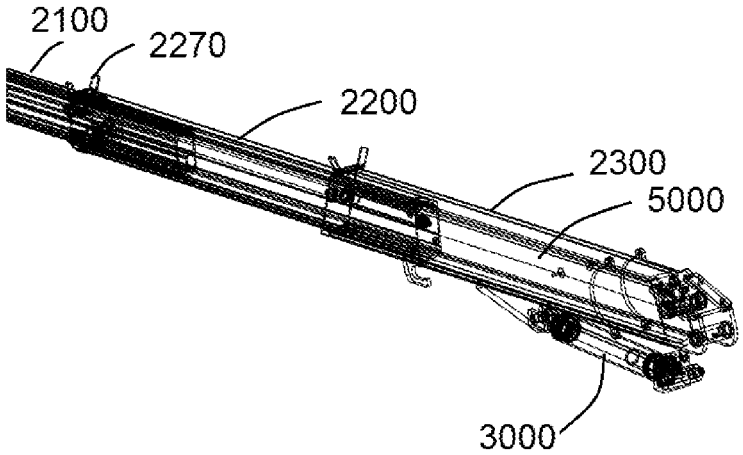
FIG. 7 is a partial perspective view of a boom in accordance with an example of the invention.
Figure 8:
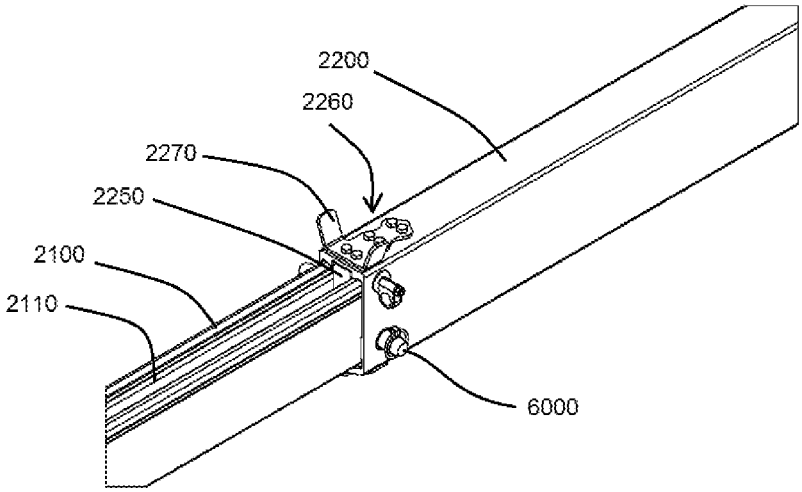
FIG. 8 is a partial perspective view of a boom in accordance with an example of the invention.
Figure 9:
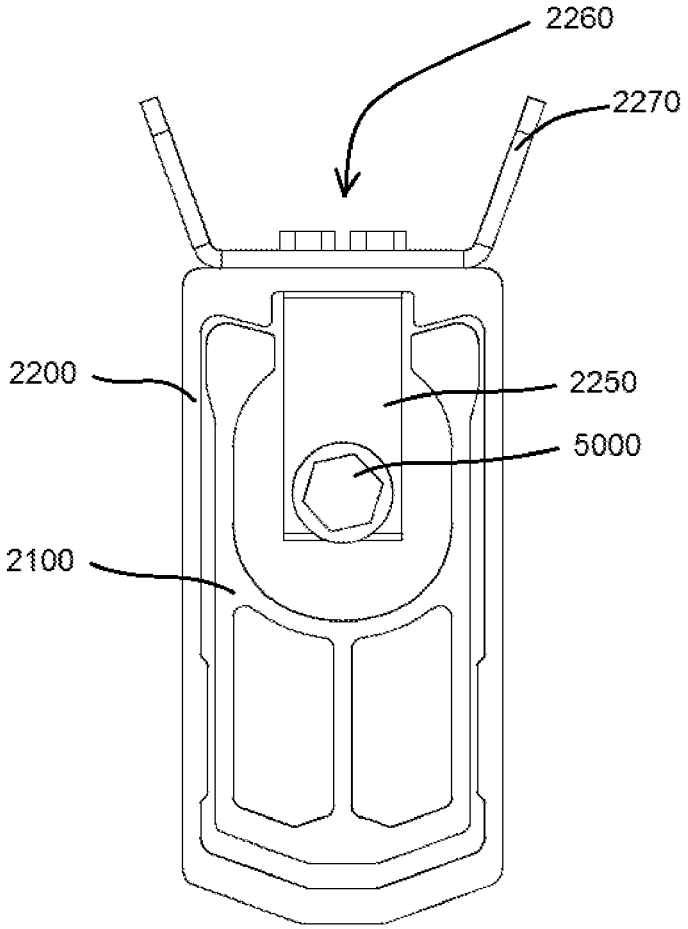
FIG. 9 is a cross-section of the telescoping boom in accordance with an example of the invention.
Figure 10:
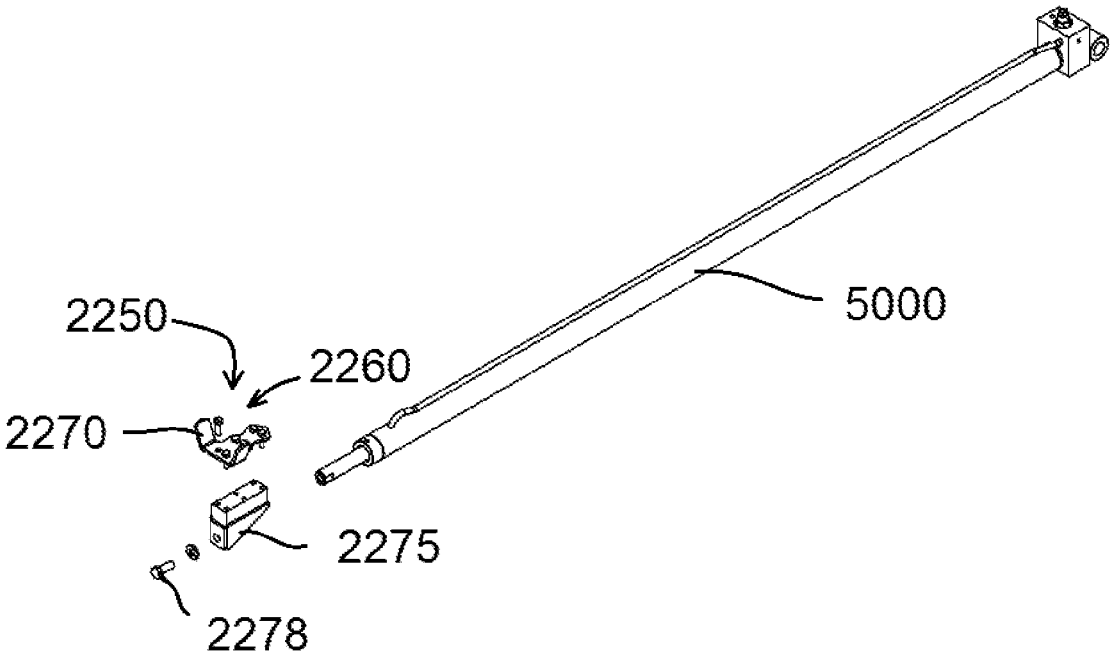
FIG. 10 view of an actuator and a structural member in accordance with an example of the invention.
Figure 11:
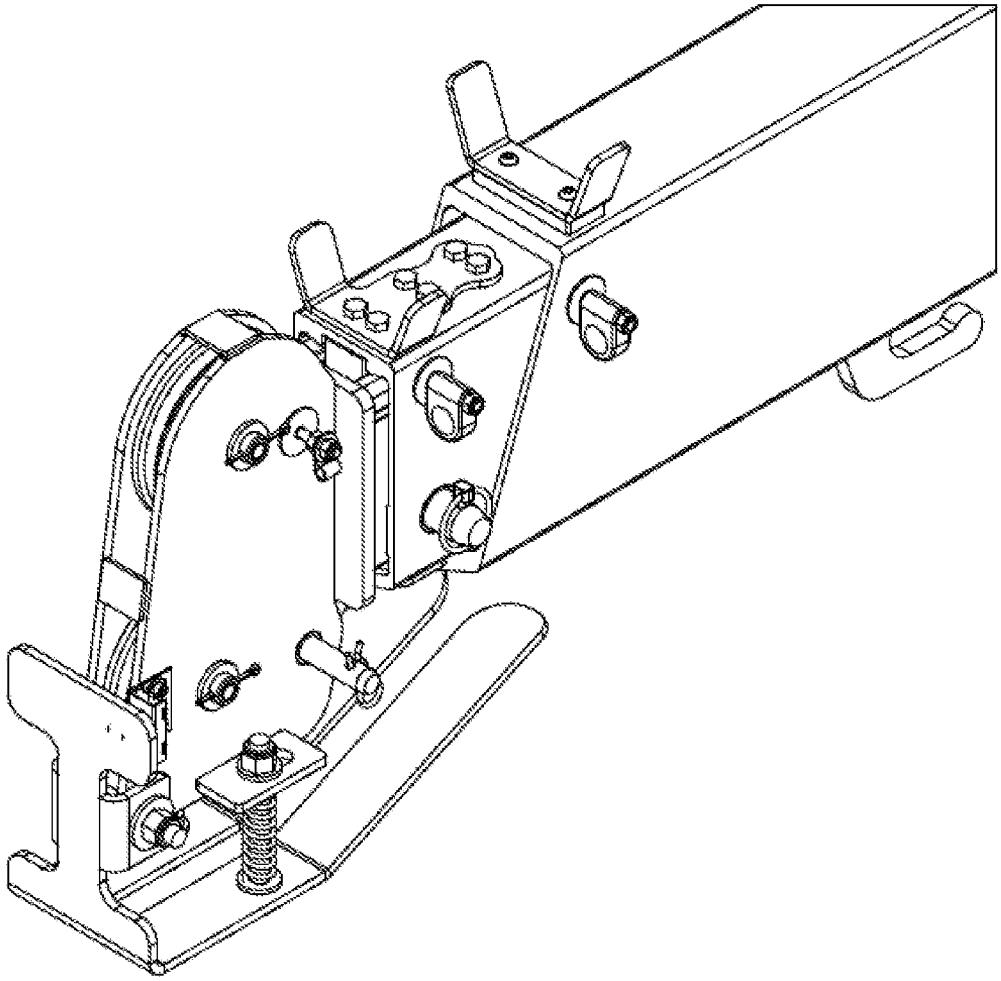
FIG. 11 is a close up view of a horsehead in accordance with an example of the invention.
Figure 12:
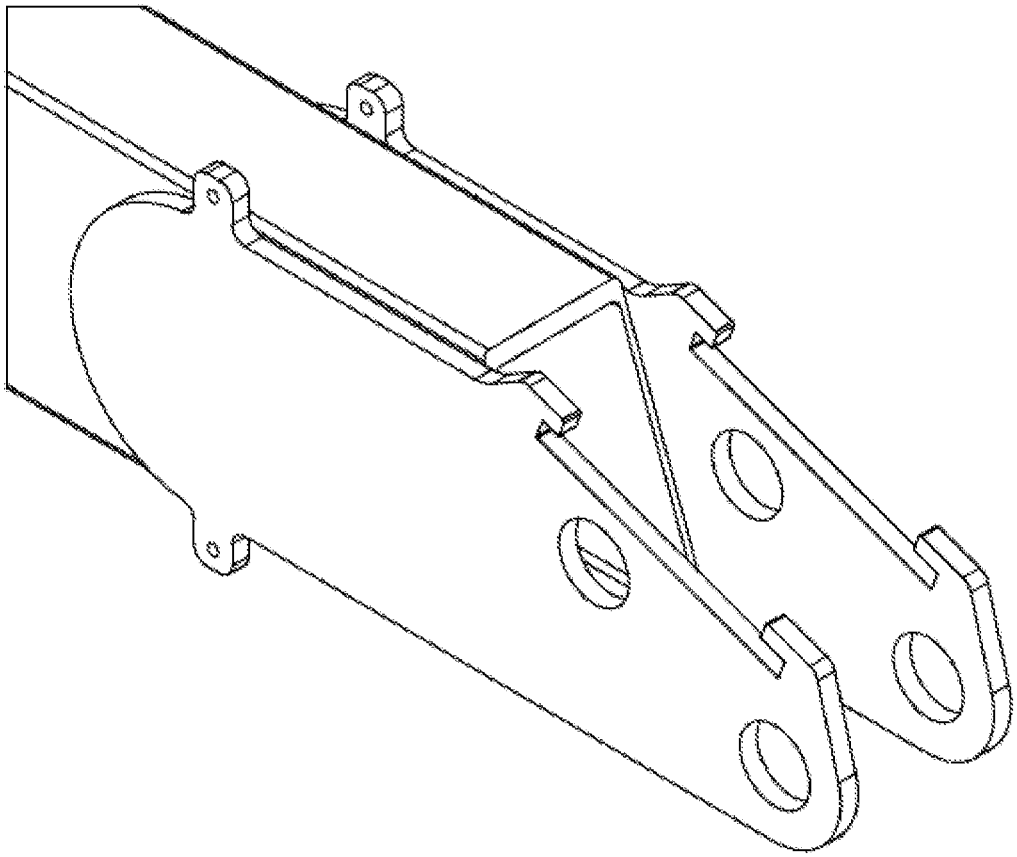
FIG. 12 is view of side plates attached to an end of the third boom in accordance with an example of the invention.

In example embodiments, the crane 1000, as described above, may include the second actuator 5000. The second actuator 5000 may be at least partially enclosed by the first, second, and third booms 2100, 2200, and 2300. For example, as shown in FIGS. 2C, 7 and 8, the second actuator 5000 may be a hydraulic cylinder having a barrel end arranged near the first end 2010 of the boom 2000 and a rod end connected to a structure 2250 that may be attached to the second boom 2200. The structure 2250, for example, may resemble a block configured to connect to the rod end of the second actuator 5000. The structure 2250, in one nonlimiting example embodiment, may be connected to the second boom 2200 by fasteners 2260, a mounting plate 2270, and a mounting block 2275. The mounting plate 2270 may be mounted on an outside of the second boom and the mounting block 2275 may be mounted in an inside of the second boom 2200. A screw 2278, in this nonlimiting example embodiment, may attach the rod to the mounting block 2275 thereby connecting the second actuator 5000 to the second boom 2200. In example embodiments the second boom 2200 may be moved along the third boom 2300 by operating the second actuator 5000.

In example embodiments the first boom 2100 may slide along the second boom 2200 in a telescoping manner. This is possible due to the open section 2110 of the first boom 2000. That is, the structure 2250 and rod of the second actuator 5000 may be accommodated within the open section 2110 as the first boom 2100 moves within the second boom 2200. In example embodiments the first boom 2100 may be connected to the second boom 2200 via a pin. For example, the first boom 2100 may include a first aperture 2102 near a first end thereof and a second aperture 2104 near a second end thereof (see FIG. 4B). The second boom 2200 may include an aperture 2202 near a first end which may be of similar size to the first and second apertures 2102 and 2104 of the first boom 2100. A pin 6000 may then be used to pin the first boom 2100 to the second boom 2200 to prevent relative motion between the two booms. For example, if it is desired to have the first boom 2100 extending out of the second boom 2200, an artisan may position the first boom 2100 so its second aperture 2104 is aligned with the second boom's aperture 2202 and the pin 6000 may be inserted into the apertures 2104 and 2202 to pin the first boom 2100 to the second boom 2200 as shown in FIG. 2A. However, if the user wishes to have the first boom

2100 substantially inside the second boom 2200 (to shorten the boom 2000 length as in FIG. 1), the user may slide the first boom 2100 into the second boom 2200 until its first aperture 2102 is aligned with the second boom's aperture 2202 and the pin 6000 may be inserted into the apertures 2102 and 2202 to pin the first boom 2100 to the second boom 2200 as shown in FIG. 1.

In the conventional art, telescoping boom members of a crane are generally made of steel or some other relatively heavy metal. However, the crane 10000 of example embodiments may be made from material typically not suitable for cranes. For example, in one nonlimiting example embodiment, the booms 2100, 2200, and 2300 are made from aluminum. This is only possible in consideration of the various inventive design features cited herein. Furthermore, the example booms 2100, 2200, and 2300 may be made from an extrusion process which allows great flexibility in the design of the sections. For example, if necessary, certain elements may be thickened to reduce stress and/or increase stiffness of an element.

In example embodiments the walls of the booms 2100, 2200, and 2300 may have varying thickness. Small strips of thicker wall can be added to the inside of boom 2200 to add stability to boom 2100. Since the primary bending load on the booms may be in one direction, more material may be placed at the top and bottom of the sections to maximize resistance to bending in the direction needed.

As previously explained, substantially V-shaped profile bottoms may allow the booms 2100, 2200, and 2300 to center themselves. This may prevent them from sliding side to side within one another. This shape may also reduce stress concentration that would otherwise occur at the ninety degree corners of a flat bottom design.

Traditional manufacturing techniques used for steel mechanics cranes do not directly carry over to aluminum cranes. For example, crater cracks tend to form when using traditional welding methods such as MIG (metal inert gas). Traditional welding of tempered aluminum may also result in the loss of temper and therefore a weaker heat affected zone around the weld. To reduce those issues the inventors have used friction stir welding (FSW) as an alternative to traditional fusion techniques. FSW is a solid state process which may avoid melting the material and therefore may maintain much of the original strength. It has a much smaller heat affected zone. FSW doesn't create crater cracks or stress concentrations as may be created using traditional welding techniques.

Designing with a lower strength material also presents a challenge in a confined area. There may not be enough room for the additional material needed for strength. Also, tapped holes may not be an option for high load applications. Structural fasteners in this application used through-holes and bolts with nuts, however, this is not intended to limit the invention.

One more concern with using aluminum is the potential for galvanic corrosion created when steel and aluminum parts are in contact with one another. This corrosion can weaken the structure of the crane as well as damage the appearance. To mitigate these corrosion issues electrically insulating barriers can be placed between the dissimilar metals in vulnerable areas. Minimizing the contact area and also using materials less reactive to one another are other methods used to limit corrosion.

Two main benefits of Applicant's invention in which aluminum is used as the structural material are weight savings and corrosion resistance. Weight reduction increases the carrying capacity of trucks. This may allow for more tools or parts while staying under weight limits. A lighter manual extension (for example, manually moving boom 2100 within boom 2200) decreases the operator effort needed to extend or retract the boom. The natural corrosion resistance of aluminum may help extend the lifespan and maintain the appearance of the crane. Anodizing is one coating option with aluminum that can help retain a new appearance, increase corrosion resistance, increase surface hardness, and electrically insulate.

Initially, the inventor sought to reduce crane weight and increase corrosion resistance while maintaining current cost. Fiberglass composite materials as well as aluminum were two of the alternate materials first investigated. The inventor found early on that aluminum would be more cost effective and gave more freedom in profile design. The first draft of the inventor's design was an aluminum crane using a traditional tube design. The main differences between the inventor's new design and the conventional art were the lack of spacers needed to create the proper clearances between profiles and then being slightly optimized for resistance for bending in the primary load direction. However, the original approach resulted in a disadvantage of having taller than necessary boom and boom profiles only for the purpose of housing the extension cylinder. This problem discouraged the use of aluminum as a material for the crane design. Because the original design utilized a case-fed cylinder, traditional structural members and traditional crane design methods presented no effective way of reducing this section height while keeping the cylinder inside of the booms. Given that the cylinder was to be case-fed for cost and that the cylinder was to be housed inside of the booms for appearance, the inventor departed from traditional crane design concepts and, instead, designed the boom profile around the extension cylinder. Continuing down that path, the inventor realized that all that was necessary was a small opening in the boom profile to allow the mounting of the cylinder rod to boom.

The foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that which falls within the scope of the claims.

What is claimed is:

1. A light-weight crane comprised of:

a telescoping boom comprised of a first, second, and third boom;

an actuator at least partially enclosed by the second and third booms, a first end of the actuator connected to the second boom by a connector so that as the actuator extends and retracts the second boom slides with respect to the third boom but the first boom does not slide within the second boom; and a horsehead arranged at one end of the boom, wherein the first boom includes a first side wall and a second side wall offset from one another so that the connector slides between the first side wall and the second side wall when the first boom moves with respect to the second boom and wherein the first, second and third booms are comprised of aluminum.

2. The light-weight crane of crane 1, wherein the actuator at least partially enclosed by the first boom.

3. The light-weight crane of crane of claim 2, wherein the first boom is configured to self align with the second boom.

4. The light-weight crane of claim 3, wherein the first boom includes a pair of external inclined surfaces configured to engage a pair of internal inclined surfaces of the second boom.

5. The light-weight crane of claim 3, wherein the second boom is configured to self align with the third boom.

6. The light-weight crane of claim 5, wherein the second boom includes a pair of external inclined surfaces configured to engage a pair of internal inclined surfaces of the third boom.

7. The light-weight crane of claim 2, further comprising:

a structural member attached to the second boom which connects an end of the actuator to the second boom so that as the actuator extends the second boom slides within the third boom.

8. The light weight crane of claim 2, wherein the first boom includes a cross-section having an open section configured to accommodate the actuator and a closed section configured to transfer shear forces.

9. The light-weight crane of claim 1, wherein the first boom includes a first aperture at a first end thereof and a second aperture at a second end thereof and the second boom includes a third aperture which may be aligned with the first aperture and the second aperture.

10. The light-weight crane of claim 9, further comprising:

a pin configured to pass through the first aperture and the third aperture to lock the light-weight crane in a first configuration and second and third aperture to lock the light-weight crane in a second configuration.

11. The light-weight crane of claim 1, wherein the first side wall and the second side wall terminate in thickened ends between which the connector resides.

12. The light-weight crane of claim 1, wherein the first side wall and the second side wall terminate in thickened ends having sloped surfaces facing sloped surfaces of the second boom.

13. A light-weight crane comprised of:

a telescoping boom comprised of a first boom, a second boom, and a third boom, wherein the first boom is configured to slide within the second boom and the second boom is configured to slide within the third boom;

a first actuator configured to pivot the telescoping boom; and a second actuator configured to move the second boom with respect to the third boom, wherein when second actuator moves the second boom with respect to the third boom the first boom does not move with respect to the second boom, a cross-section of the first boom includes an open section which accommodates the second actuator and a closed section to transfer a shear load, and each of the first, second, and third booms are made from aluminum.

14. The light-weight crane of claim 13, wherein the first boom includes a pair of external inclined surfaces configured to engage a pair of internal inclined surface of the second boom.

15. The light-weight crane of claim 14, wherein the second boom includes a pair of external inclined surfaces configured to engage a pair of inclined internal surfaces of the third boom.

16. The light-weight crane of claim 15, further comprising:

a horsehead arranged at an end of the first boom.

* * * * *